US007610764B1

(12) United States Patent
Gerringer, Jr.

(10) Patent No.: US 7,610,764 B1
(45) Date of Patent: Nov. 3, 2009

(54) VORTEX HEAT TRANSFER DEVICE

(76) Inventor: William E. Gerringer, Jr., 604 Crosspointe La., Garner, NC (US) 27529

( * ) Notice: Subject to any disclaimer, the term of this patent is extended or adjusted under 35 U.S.C. 154(b) by 594 days.

(21) Appl. No.: 11/307,261

(22) Filed: Jan. 30, 2006

(51) Int. Cl.
*F25B 9/02* (2006.01)

(52) U.S. Cl. ..... 62/5

(58) Field of Classification Search ..... 62/5; 165/201, 178
See application file for complete search history.

(56) References Cited

U.S. PATENT DOCUMENTS 3,630,040 A * 12/1971 Goldfarb ..... 62/5
4,594,084 A * 6/1986 Lopez ..... 62/5
6,250,796 B1 * 6/2001 Huang ..... 366/270

* cited by examiner

*Primary Examiner*—Melvin Jones

(57) ABSTRACT

A vortex heat transfer device includes coaxial helical coil impellers operating at differing rotational speeds that are effective for mechanically establishing the vortices and allowing controlled heating and cooling between return and supply air streams. The outer impeller rotates at a multiple of the inner impeller speed, rapidly and compactly compressing the return air heating at the outer boundary and creating an inner boundary of low pressure of cooled air, which is reversely helically directed by the inner impeller for additional thermal separation. The conditioned air is delivered to the supply system. In the cooling mode, a discharge system removes heated air and condensed water vapor. The discharge system is thermostatically controlled for establish desired heating and/or cooling temperatures in a space to be conditioned.

9 Claims, 4 Drawing Sheets

VORTEX HEAT TRANSFER DEVICE

FIELD OF THE INVENTION

The present invention heat transfer devices and, in particular to a heat and cooling device using mechanically assisted vortex flows.

BACKGROUND OF THE INVENTION

Heat transfer devices using vortex flows to establish cooling gradients have been used in various applications. Known commonly as vortex or Hilsch tubes, compressed air is tangentially directed into an internal counterbore that sets the air stream into a vortex motion. A valve at the end of the tube allows some of the warmed air to escape. The remainder turns back down the tube as a second vortex inside the low pressure area of the larger vortex. The inner vortex looses heat and exhausts through the other end as cold air. Temperatures as low as −50° F. and as high as +260° F. are deemed possible.

SUMMARY OF THE INVENTION

The present invention provides an improved vortex based heat transfer device wherein coaxial helical coil impellers operating at differing rotational speeds, directions, and pitch are effective for mechanically establishing the vortices and allowing controlled heating and cooling between return and supply air streams. In a preferred embodiment, the outer impeller rotates at a multiple of the inner impeller speed, rapidly and compactly compressing the return air heating at the outer boundary and creating an inner boundary of low pressure of cooled air, which is stripped and reversely impelled the inner impeller to establish a secondary vortex path for additional thermal separation. The conditioned air is delivered to the supply system. In the cooling mode, a discharge system removes heated air and condensed water vapor. The discharge system is thermostatically controlled for establish desired heating and/or cooling temperatures in a space to be conditioned. The invention thus provides a heat transfer device using coaxial rotating impellers for establishing vortices for thermally separating an entering air stream for heating and cooling applications.

BRIEF DESCRIPTION OF THE DRAWINGS

The above and other features and advantages of the present invention will become apparent upon reading the following description taken in conjunction with the accompanying drawing in which.

DESCRIPTION OF THE PREFERRED EMBODIMENTS

Figure 1:
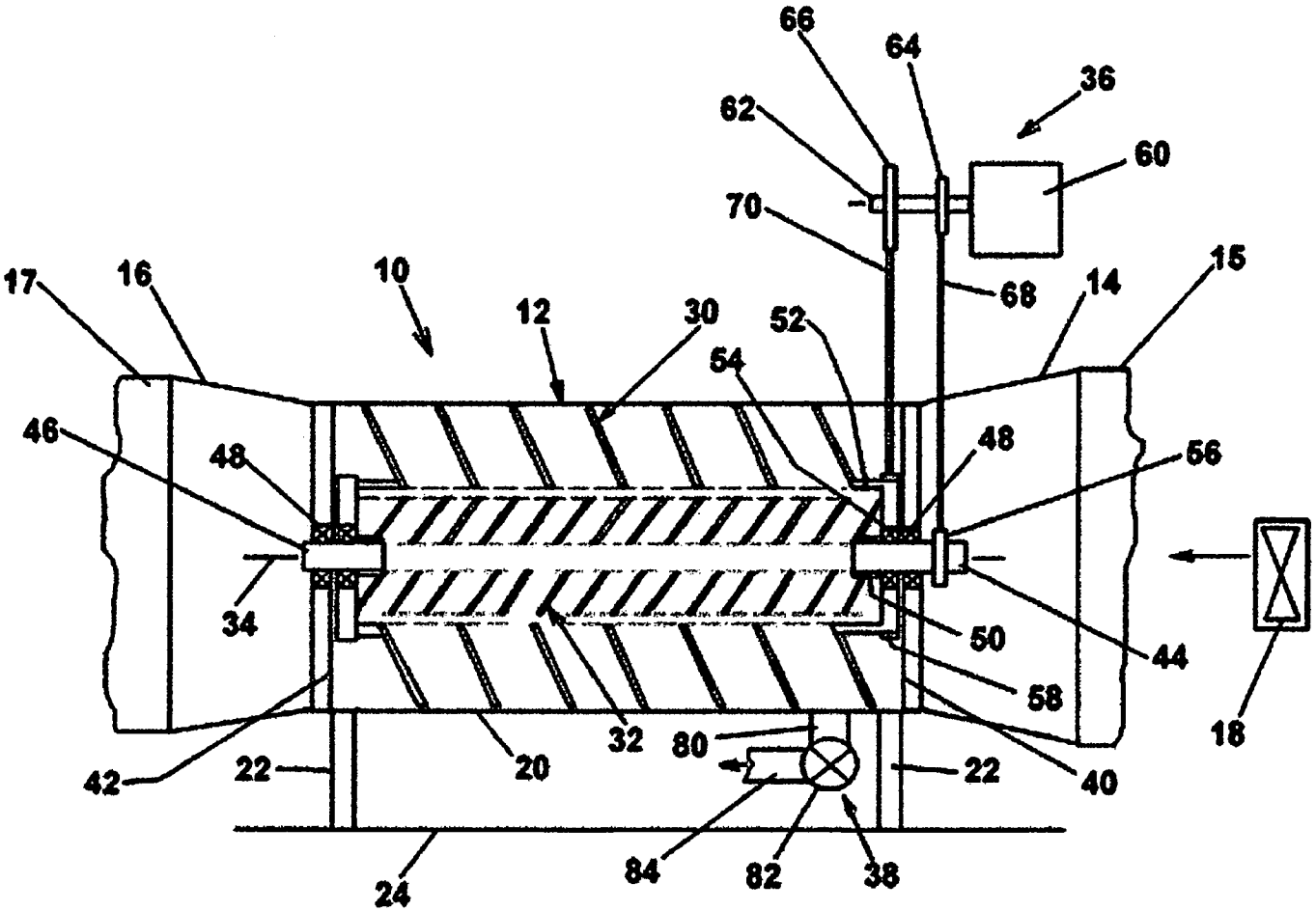
FIG. 1 is a cross sectional view of a vortex heat transfer device in accordance with an embodiment of the invention.

Referring to FIG. 1, there is shown a vortex heat transfer system 10 having a heat exchanger 12 with an inlet plenum 14 fluidly accepting return air from a return conduit 15 and an outlet plenum 16 delivering conditioned supply air in a supply conduit 17 with flow assisted by a fan 18 of a type generally employed in the circulation system. The plenums are generally frustoconical and may be connected in a closed loop system with conventional ducting for conditioning an enclosure or and open loop system for supplying conditioning to discrete surroundings.

The heat exchanger housing 12 includes a cylindrical outer casing 20 mounted on support brackets 22 to a support surface 24. The casing 20 coaxially supports a helical outer impeller assembly 30 and a helical inner impeller assembly 32 for rotation about a longitudinal axis 34 as driven by drive assembly 36. A metering assembly 38 is provided in the casing 20 for metering air and water discharge for temperature control during operation as described below.

The impeller assemblies 30, 32 are mounted in the casing 20 on a bracket assemblies 40, 42 adjacent the ends of the casing. The bracket assemblies 40, 42 include support shafts 44, 46 at bearings 48 for rotation on the axis 34. The inner ends of the support shafts 44, 46 are connected to the ends of the inner impeller assembly 32 at inner support hubs 48. Outer support hubs 50 are carried at bearings 52 on the shafts 44, 46 and connected to the ends of the outer impeller assembly 30. An outer impeller drive pulley 54 is carried on the hub 50. An inner impeller drive pulley 56 is supported on the outer end of the shaft 44.

Figure 2:
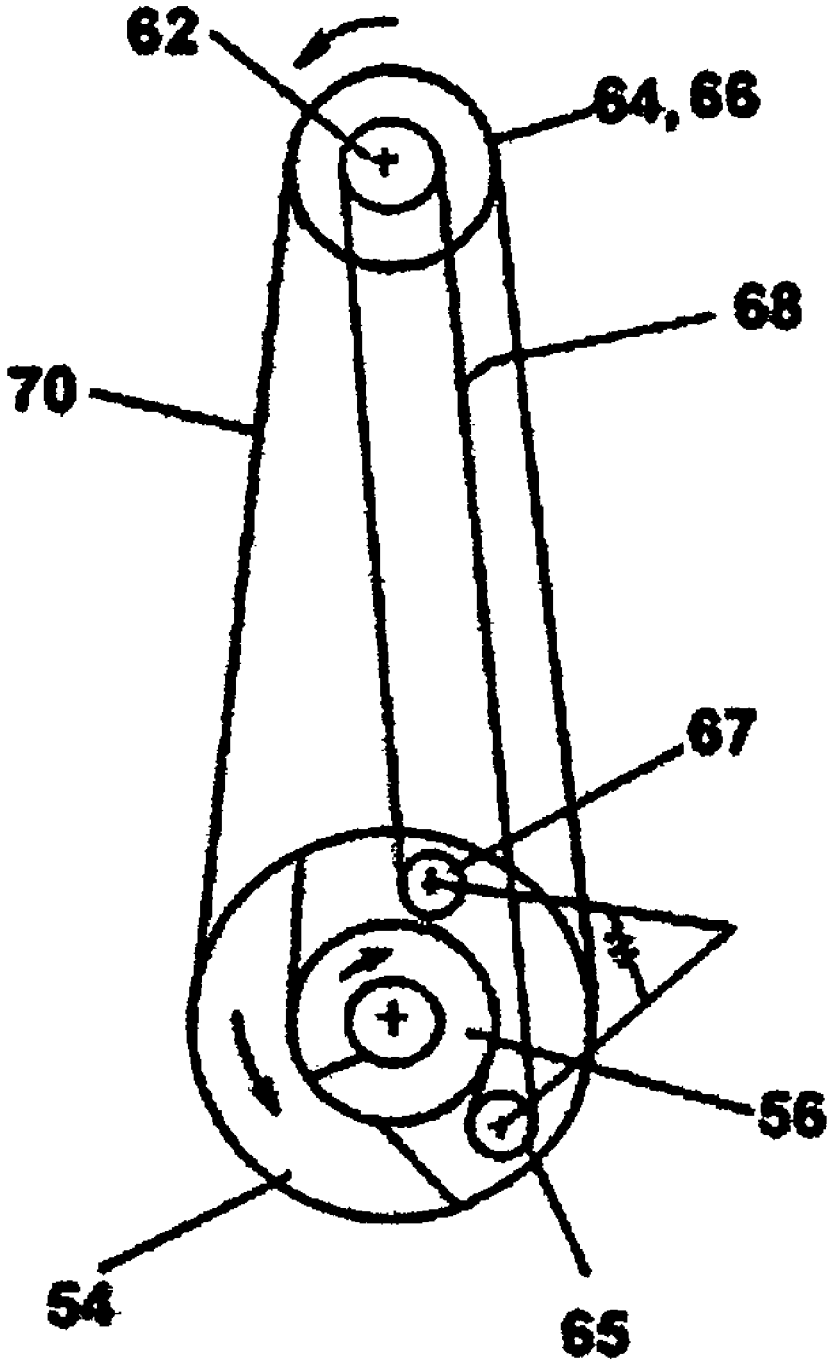
FIG. 2 is a side view of the drive system for the vortex heat transfer device of FIG. 1.

Referring additionally to FIG. 2, the drive assembly 36 includes a drive motor 60 having an output shaft 62 supporting drive pulleys 64, 66. A drive belt 68 drivingly connects the drive pulley 64 and idler pulleys 65, 67 with drive pulley 56 to rotate the inner impeller assembly 32 in a counter clockwise direction. A drive belt 70 connects the pulley 66 with pulley 54 to rotate the outer impeller assembly 30 in the clockwise direction. The drive ratios provide for increased speed of the outer impeller assembly 30 with respect to the speed of the inner impeller assembly 32. A ratio in the range of about 2:1 to 20:1, a range of about 5:1 to 15:1 desirable, and a range of about 10:1 preferred.

Figure 4:
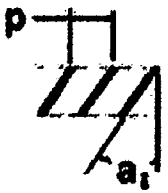
FIG. 4 is a view of the inner impeller circled in FIG. 3.
Figure 5:
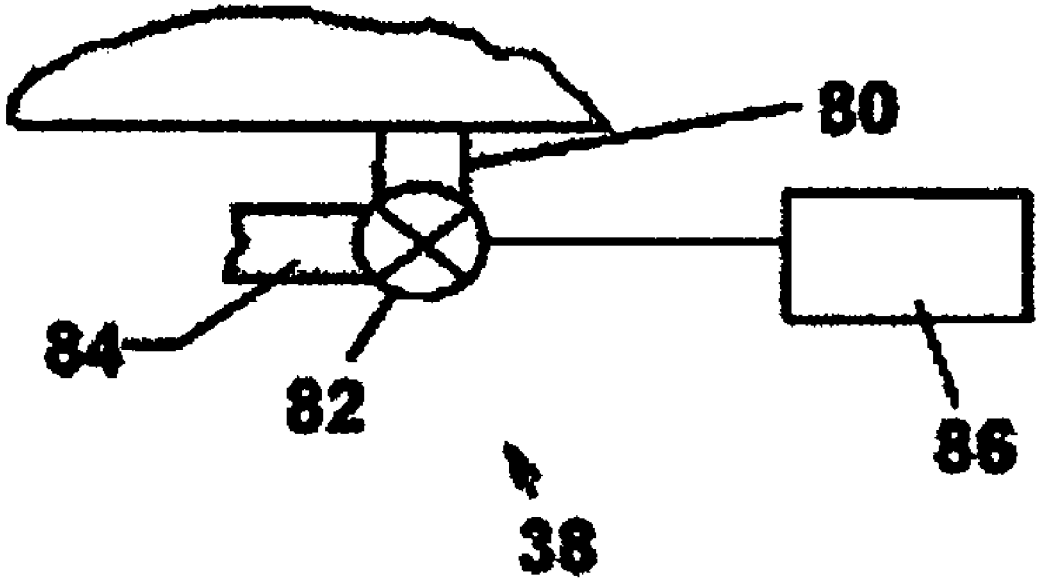
FIG. 5 is a fragmentary view of the metering system of the heat transfer device of FIG. 1.

Referring additionally to FIG. 4, the metering assembly 38 serially includes a conduit 80 having an inlet at the interior of the casing 20 and an outlet at a metering valve 82 terminating with a drain conduit 84. The valve 82 is controlled by a thermostatic control unit 86 for providing metered operation in accordance with conditions to be maintained in the area being conditioned.

Figure 3:
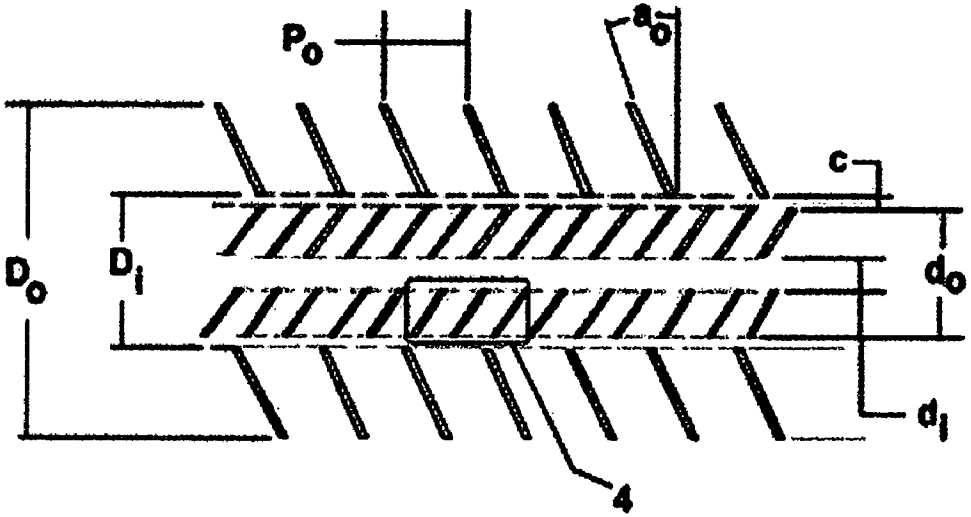
FIG. 3 is a side view of the impellers of the heat transfer device.

Referring to FIG. 3, outer impeller assembly 30 includes an outer screw member 90 formed of a continuous helical strip having a right hand screw thread. The outer screw member circumscribes an outer diameter "$D_o$" an inner diameter "$D_i$", a pitch "$P_O$" and a pitch angle "$A_O$". The inner ends of the outer screw member 90 are mounted on the hubs 50. The inner impeller assembly 32 includes and inner screw member 92 formed of a continuous helical strip having a left hand screw thread. The inner screw member 92 circumscribes an outer diameter "$d_o$" an inner diameter "$d_i$", a pitch "$p_i$" and a pitch angle "$a_i$". The outer diameter of the inner screw member has a clearance "c" with the inner diameter of the outer screw member. The clearance is small ranging between 0.500 inch and 0.001, with a clearance of about 0.005 inch preferred. The outer screw assembly 90 thus imparts a vortex flow in a first helical direction toward the supply conduit. The inner screw assembly imparts a vortex flow an opposed second helical direction toward the supply conduit.

In operation, the outer impeller assembly 30 imparts a spiral vortex flow to the incoming return air, of greater velocity than imparted passively in static vortex tubes by tangential injection of compressed air. This results in a compression of the air and resultant outer boundary of increasingly elevated temperature along the length of the outer screw member, and an axially inwardly flow of a portion of the air at increasingly reduced temperature and pressure. The inward flow at reduced pressure and temperature is stripped by the inner impeller assembly 32 and reversely vortexed toward the supply. The water content of the air is condensed on the inner screw member and impelled radially for collection at the drainage assembly 38. In a cooling mode, as the valve 82 is opened under the control of the control unit 86, a portion of the heated air and liquid at the outer periphery is discharged through conduits 80, 84 thereby providing an exit flow to the supply at decreased temperature and humidity.

Demonstrated operation of the system was provided by a prototype unit constructed in accordance with the described embodiment and provided the results set forth in the following example.

EXAMPLE 1

The heat transfer housing having a diameter of 12 inches and a length of the 36 inches was connected to a 14 inch flexible return duct with a 14 inch flange. Air was supplied to the return duct with an 800 cfm squirrel cage blower with a ⅓ hp motor. Air was delivered to a 14 inch flexible supply duct at a 14 inch flange. The outer screw member had an 8 inch outer diameter and a 5 inch inner diameter with a 170 pitch. The inner screw member had a 4 15/16 inch outer diameter and a 2 inch inner diameter. A ¾ hp electric motor having an output shaft speed drove the outer screw member at 8,000 rpm and the inner screw member at 800 rpm.

In a cooling mode, air was delivered in the return at 72° F. and a 68° F. dew point. Metering valve discharge was 89° F. and a 77° F. dew point. Air was delivered to the supply at 44° F. and a dew point of 54° F. In the heating mode, air was delivered in the return at 68° F. with a dew point of 68° F. No flow was discharged at the metering valve. Air was delivered to the supply at 144° F. with a dew point of 72° F.

It will thus be appreciated that the present invention utilizes the mechanically induced counter directed vortices for the effective separation of thermal gradients for heating and cooling purposes.

Having thus described a presently preferred embodiment of the present invention, it will now be appreciated that the objects of the invention have been fully achieved, and it will be understood by those skilled in the art that many changes in construction and widely differing embodiments and applications of the invention will suggest themselves without departing from the spirit and scope of the present invention. The disclosures and description herein are intended to be illustrative and are not in any sense limiting of the invention, which is defined solely in accordance with the following claim.

What is claimed is:

1. A heat transfer device comprising: a cylindrical casing having a longitudinal axis and an inlet at one end for returning air to be conditioned in an inlet stream and at outlet at another end for supplying conditioned air in a outlet stream; coaxially disposed inner and outer impeller members in said casing for rotation about said longitudinal axis, each of said impeller members having helical surfaces for imparting vortex flow to surrounding air wherein said helical surfaces are oppositely disposed with respect to said longitudinal axis; drive means operatively connected to said impeller members for rotating said impeller members about said longitudinal axis and establishing vortex flows thereat wherein said drive means rotate said impeller members in different directions and at different rotational rates; and means at said casing for removing a portion of said inlet stream to effect a desired temperature condition for said outlet stream.

2. The heat transfer device as recited in claim 1 wherein said outer impeller member rotates at a greater speed than said inner impeller member.

3. The heat transfer device as recited in claim 2 wherein the rotational speed ratio between said outer impeller member and said inner impeller member is around 2:1 to 20:1.

4. The heat transfer device as recited in claim 2 wherein said ratio is around 5:1 to 15:1.

5. The heat transfer device as recited in claim 4 wherein said ratio is around 10:1.

6. The heat transfer device as recited in claim 1 wherein said means for removing includes a conduit having an inlet at said casing and an outlet at a valve member that is adjustable for removing said portion of said inlet flow.

7. The heat transfer device as recited in claim 1 wherein said valve member is thermostatically controlled to establish a desired temperature in said outlet stream.

8. The heat transfer device as recited in claim 1 wherein a diametral clearance between the outer diameter of the inner impeller member in the inner diameter of the outer impeller member is provided of about 0.5 inch or less.

9. A heat transfer device comprising: a cylindrical casing having a longitudinal axis and an inlet at one end for returning air to be conditioned in an inlet stream and at outlet at another end for supplying conditioned air in a outlet stream; an inner impeller member surrounded by an outer impeller member and mounted within said casing for coaxial rotation about said longitudinal axis, each of said impeller members having helical surfaces for imparting vortex flow to surrounding air; drive means operatively connected to said impeller members for rotating said impeller members about said longitudinal axis and establishing vortex flows thereat wherein said drive means rotate said outer impeller member at a faster rotational rate than said inner impeller member; and means at said casing for removing a portion of said inlet stream to effect a desired temperature condition for said outlet stream.

* * * * *